United States Patent [19]

Shutie et al.

[11] 4,066,038

[45] Jan. 3, 1978

[54] PRINTING AND COATING APPARATUS

[75] Inventors: Orin S. Shutie, Greenford; Leonard A. Jenkins, Newbury, both of England

[73] Assignee: Metal Box Limited, England

[21] Appl. No.: 704,789

[22] Filed: July 13, 1976

[30] Foreign Application Priority Data

July 23, 1975 United Kingdom ..... 30728/75

[51] Int. Cl.[2] ..... B05C 1/02

[52] U.S. Cl. ..... 118/218; 118/223; 118/230

[58] Field of Search ..... 118/218, 219, 232, 223, 118/233, 230, 46; 101/38 R; 427/428, 409, 410

[56] References Cited

U.S. PATENT DOCUMENTS

| | | | |
|---|---|---|---|
| 1,779,638 | 10/1930 | Pilkington | 118/218 |
| 3,388,686 | 6/1968 | Cohan | 118/232 X |

*Primary Examiner*—John P. McIntosh

*Attorney, Agent, or Firm*—Diller, Brown, Ramik & Wight

[57] ABSTRACT

This invention relates to a method and apparatus, for applying a first and second coating to the exterior surface of a can. The apparatus comprises a mandrel rotatably mounted on a pivotable arm, so that pivoting of the arm carries a can on the mandrel to a first position, in which it is held by a solenoid acting upon a portion of the arm, while a first coating means applies a first coating. Thereafter the arm is released for pivoting to a second position where it is held by a second holding means while a second coating means applies a second coating.

8 Claims, 3 Drawing Figures

PRINTING AND COATING APPARATUS

The present invention relates to the coating of hollow articles and more especially, although not exclusively, to the printing and over-varnishing of cans drawn from sheet metal.

Production machines for applying coatings to the exterior drawn cans are known, in which the clean cans are mounted on the mandrels of a rotating turret for transport to a printing station and then carried, on the mandrel, to a varnishing station where varnish is applied over the print before any stoving to cure the coatings. However there is a need for a simpler machine suitable for pre-production trials of the coating materials used for print and over-varnishes, and although the present invention provides apparatus for such purposes, it is not limited thereto.

In one aspect the invention provides a method of coating a hollow article, said method comprising the steps of feeding an article onto a mandrel rotatably mounted on a pivotable arm, pivoting said arm from the article-feeding position to a first coating position in which the article is engaged with a first coating means for a controlled period of coating, pivoting the arm away from the first coating means to a second coating position intermediate to article-feeding and first coating positions, at which a second coating means is brought to apply a second coating to the article, pivoting the arm back to the article-feeding position, and removing the coated article from the mandrel.

In another aspect the invention provides apparatus for coating an article, said apparatus comprising a mandrel adapted to support an article and rotatably mounted on an arm pivotable from an article feeding position to first and second coating positions, a first holding means to hold the arm in a first coating position, a first coating means, a second holding means to hold the arm in a second coating position, and a second coating means. The preferred holding means for holding the mandrel at the first coating means is a solenoid acting on a portion of the arm. The solenoid may also be used to control duration and pressure of contact. The preferred means for holding the mandrel at the second coating means is a combination of a latch and spring acting upon a portion of the arm. The spring may be used to move the arm, and therefore the mandrel, from the first coating means towards the second coating means.

Figure 1:
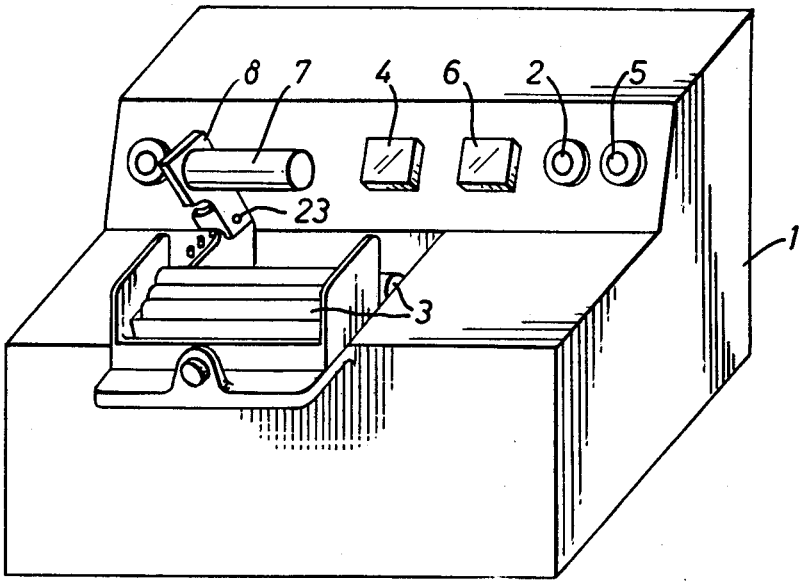
Figure 2:
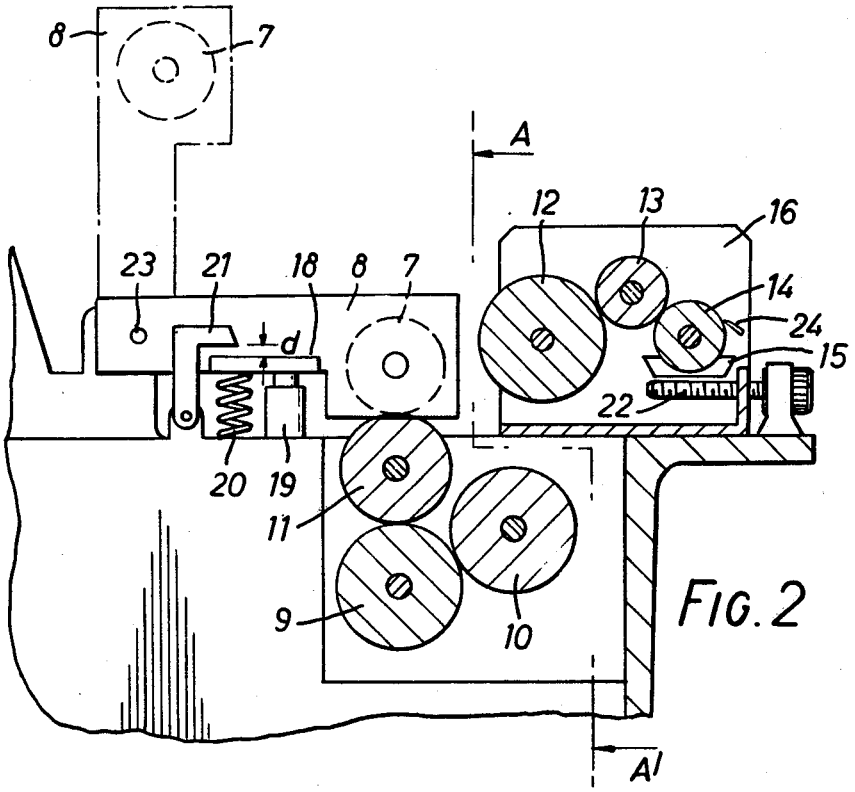
Figure 3:
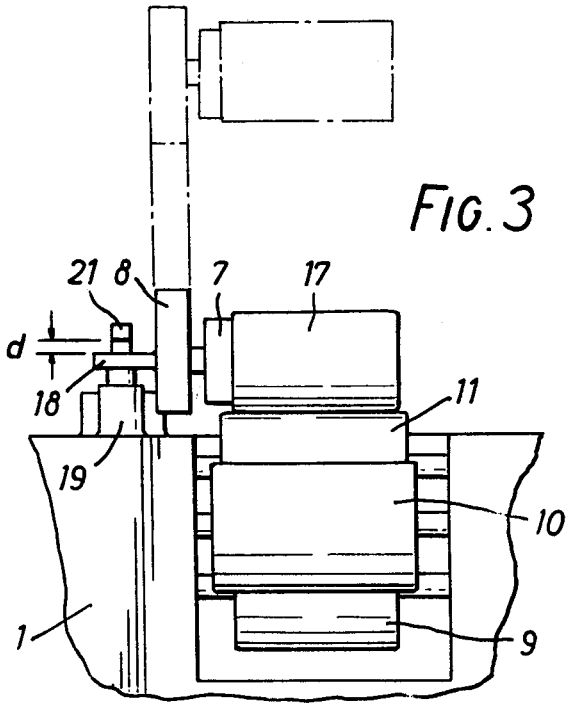

One embodiment of the invention will now be described, by way of example, and with reference to the accompanying drawings, of which:

FIG. 1 is a perspective sketch of apparatus for coating a hollow article;

FIG. 2 is a detailed part sectioned elevation of part of the apparatus of FIG. 1; and FIG. 3 is a front elevation of the apparatus of FIG. 2, from which the second coating means has been omitted for clarity The invention will be described by way of non limiting example, in terms of attachments for a laboratory tackmeter such as one manufactured by the Churchill Instrument Company Limited of Greenford, Middlesex, UK. Such tackmeters measure the resistance of an ink film to splitting such as occurs during the disbribution of ink over the rollers of a printing machine. The Churchill instrument consists essentially of a polished stainless steel roller which is driven by an electric motor which is controllable to provide roller speeds in the range of 0 to 2000 R.P.M. The temperature of the stainless steel roller is controlled by passing water at constant temperature through the roller. Suitable temperatures are in the range 75° F to 120° F. The printing ink to be tested is deposited from an ink pipette onto the stainless steel roller and simultaneous rotation of the stainless steel roller and a contacting rubber covered spreading roller, which oscillates axially, causes even distribution of the ink in the rollers in the manner of a printing machine. To measure tack a steel rider roll, connected to an electrical measuring system, is brought to contact the ink layer on the stainless steel roller and measure tack.

However, for the purpose of the present invention the apparatus is used to provide the controlled speed of roll rotation and the desirable thermal control of the ink temperature.

In FIG. 1 the tackmeter 4 has a control knob 2 to permit adjustment of the speed of rotation of the rolls, generally denoted 3, and indicated on the tackmeter 4. A further control knob 5 permits control of the temperature of the printing ink, as indicated on the gauge 6.

According to the invention, a rotatable mandrel 7 adapted to receive a can body is mounted on an arm 8. The arm is pivotally mounted at 23 so that a can on the mandrel may be moved in succession between a first coating position and a second coating position as is to become apparent.

FIG. 2 shows the arrangement of the arm 8, a first coating means and a second coating means. The first coating means comprises a hollow drive roller 9, an axially oscillating roller 10 and a jockey printing roller 11; it is essentially fixed in position. The second coating means comprises a carriage 16 carrying an applicator roller 12, a transfer roller 13, a duct roller 14 and a duct 15; it is horizontally reciprocable between its operative and retracted positions (of which the retracted position is shown) by means of a manually operable screw 22. The arm 8 is shown dotted at the position at which a can may be fed onto the mandrel 7. However FIG. 3 principally shows a can body 17 on the mandrel 7 at the first coating position where the surface of the can body 17 engages with the jockey printing roller 11.

The can and mandrel are held in the first coating position by the action of an electro magnetic solenoid 19 acting on a portion 18 of the arm against the action of a spring 20. This arrangement permits control of both the period and pressure of contact between the can and coating means. After the desired period of contact between the can body 17 and the printing roller 11, the electrol magnet releases the arm and the spring 20 pushes the arm 8 upwardly through a controlled distance "*d*" to a second position at which the second coating is applied by the second coating means after leftward movement (as shown) to its operative position. The second position of the arm is determined by a latch 21 which is manually releasable after the second coating has been applied, to allow the spring to move the arm back to its can-receiving position to enable the coated can to be removed.

By way of example the method of printing and over-varnishing a can body will now be described.

A quantity of printing ink is first deposited from an ink pipette onto the driving roller 9, and spread by means of the axially oscillating roller 10 which rotates in the opposite direction to the driven roller 9. Time is allowed for the printing ink to reach the desired temperature and distribution. The freely rotatable jockey printing roller 11, which has a printing impression on its surface is placed in the machine where it collects ink from the driving roller 9 in readiness for printing. If extended tests are required the driving roller may be continuously supplied with printing ink by known means which are not shown.

A quantity of varnish is placed in the duct 15 of the second coating means and the driving means, (not shown) set in motion so that the duct roller lifts varnish from the duct to be metered by the nip pressure between doctor blade 24 and the duct roller 14, the desired amount being picked up and carried by the transfer roller 13 to the applicator roller 12 in readiness for varnishing.

The can body is hand fed onto the can mandrel 7 at the position shown dotted in FIG. 2. The arm is then rotated about the pivot 23 to bring the portion 18 of arm 8 past the latch 21 to the electro magnet 19 which holds the arm 8, and therefore the can 17 and mandrel 7, in the first coating position at which printing ink is applied. The magnet 19 holds the can body 17 positively against the printing roller 11 for one complete revolution. It the releases the arm so that the latter is pushed upwardly by the spring 20 until arrested by the latch 21 where the latch 21 arrests it. The combination of latch 21 and spring 20 thereafter keeps the can in position while the second coating means for applying varnish, carried by the carriage 16, are brought to the can body in this embodiment, by manual rotation of the screw 22. Guideways, not shown, guide the carriage 16 until stops, also not shown, limit the travel at a suitable varnishing position. After over-varnishing the printed surface the latch 21 is disengaged and the arm 8 is retracted to the starting position. The coated can is removed for study or drying in known manner.

The means to drive the second coating or varnishing means may be of any known type such as chain drives or toothed belting and may be independantly controlled with respect to speed of rotation and temperature of application.

The apparatus and method described may be used for proving trials of new decorative designs or for the testing of coating materials. A tack measuring roller may be incorporated. Although the invention has been described with reference to apparatus for proving trails and laboratory testing, the use of the invention is not so limited, a commercial printing apparatus being within the scope of the invention - in which case the first coating means may be made continuous by the provision of a duct and doctor blade.

While the invention has been described in terms of the coating of a metal can body it is not limited thereto. The apparatus may be provided with a tapered mandrel to support and hold the tapered plastic pots, such as are used in the dairy industry: provision of suitably modified coating rolls would then be used to apply print or coatings to such pots.

We claim:

1. Apparatus for coating a hollow article, said apparatus comprising a mandrel adapted to support an article and rotatably mounted on an arm pivotable from an article feeding position to first and second coating positions, a first holding means to hold the arm in a first coating position, a first coating means adjacent said first coating position, a second holding means to hold the arm in a second coating position intermediate said first coating position and said article feeding position, and a second coating means at said second coating position.

2. Apparatus according to claim 1 wherein the holding means for holding the mandrel at the first coating means is an electro magnet acting upon a portion of the arm.

3. Apparatus according to claim 1 wherein the holding means for holding the mandrel at the second coating position is combination of a spring acting upon a portion of the arm urging said arm towards said article feeding position and a latch positioned for limiting movement of said arm by said spring.

4. An apparatus according to claim 3 wherein the holding means for holding the mandrel at the first coating means is an electro magnet acting upon a portion of the arm.

5. Apparatus according to claim 1 wherein there is a spring urging said arm towards said article feeding positions from said first coating position to move the arm from the first coating position to the second coating position.

6. Apparatus according to claim 1 wherein said second coating means includes a support means mounting said support for movement towards and away from an article at said second coating position, and feed means connected to said support for moving said support towards and from said second coating position.

7. An apparatus according to claim 6 wherein the holding means for holding the mandrel at the first coating means is an electro magnet acting upon a portion of the arm.

8. An apparatus according to claim 7 wherein the holding means for holding the mandrel at the second coating position is combination of a spring acting upon a portion of the arm urging said arm towards said article feeding position and a latch positioned for limiting movement of said arm by said spring.

* * * * *